US006247988B1

(12) United States Patent
Han et al.

(10) Patent No.: US 6,247,988 B1
(45) Date of Patent: Jun. 19, 2001

(54) SHADOW MASK FOR CATHODE RAY TUBE AND METHOD OF MANUFACTURING SAME

(75) Inventors: Dong-hee Han; Sung-hwan Moon, both of Kyungki-do; Seung-kwon Han, Seoul, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/611,362

(22) Filed: Jul. 6, 2000

Related U.S. Application Data

(62) Division of application No. 09/234,924, filed on Jan. 21, 1999, now abandoned.

(30) Foreign Application Priority Data

Jan. 22, 1998 (KR) ..... 98-1853

(51) Int. Cl.[7] ..... H01J 29/07
(52) U.S. Cl. ..... 445/47
(58) Field of Search ..... 445/7; 313/402

(56) References Cited

U.S. PATENT DOCUMENTS

| | | | | |
|---|---|---|---|---|
| 5,167,557 | * | 12/1992 | Teramoto et al. | 445/47 |
| 5,433,974 | * | 7/1995 | Lee | 427/252 |
| 5,578,898 | * | 11/1996 | Higashinakagawa et al. | 313/402 |
| 5,628,841 | * | 5/1997 | Inoue et al. | 148/310 |

FOREIGN PATENT DOCUMENTS

| | | |
|---|---|---|
| 56-121257 | 9/1981 | (JP) . |
| 62-223950 | 10/1987 | (JP) . |
| 1-276542 | 11/1989 | (JP) . |
| 208225 * | 9/1991 | (JP) . |

* cited by examiner

*Primary Examiner*—Kenneth J. Ramsey
(74) *Attorney, Agent, or Firm*—Christie, Parker & Hale, LLP

(57) ABSTRACT

Disclosed is a shadow mask for a cathode ray tube (CRT) and a method of manufacturing the same. The shadow mask includes a nitrogen compound. The method includes the steps of heat-treating a metallic plate having a plurality of apertures formed therein in the presence of a nitriding gas, and press-forming the metallic plate into a shadow mask shape.

8 Claims, 4 Drawing Sheets

SHADOW MASK FOR CATHODE RAY TUBE AND METHOD OF MANUFACTURING SAME

CROSS-REFERENCE TO RELATED APPLICATIONS

This application is a divisional of U.S. patent application Ser. No. 09/234,924 filed on Jan. 21, 1999, abandoned, which claims priority of Korean Patent Application No. 98-1853, filed Jan. 22, 1998.

FIELD OF THE INVENTION

The present invention relates to a shadow mask for a cathode ray tube (CRT) and a method of manufacturing the same, and more particularly to a shadow mask for a CRT and a method of manufacturing the same in which a nitridation process is used to produce the shadow mask, thereby improving tensional strength and certain elongation properties.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multi-apertured sheet of metal precisely disposed between the screen and the beam-producing means. The shadow mask shadows the screen, and the differences in convergence angles permit the transmitted portions of each beam to selectively excite phosphor elements of the desired emission color.

A conventional CRT shadow mask is typically manufactured by first coating a photoresist on a thin metal plate made of Invar or aluminum-killed (AK) steel. The plate is then exposed to light, developed, and etched to form a plurality of holes therein. Thereafter, the plate formed with the holes is annealed using a heat-treating process in a hydrogen atmosphere at a high temperature, thereby removing stress and providing malleability to the plate. The plate is then formed into a predetermined mask shape by a press, after which the plate is cleaned to remove all contaminants from the surface thereof including fingerprints, dust and other foreign substances. Finally, a blackening process is performed on the shaped plate to prevent doming of the same, thereby completing the manufacture of the shadow mask.

The shadow mask acts as a bridge between electron beams emitted from three electron guns (means for producing three convergent electron beams) and red, green and blue phosphor pixels formed on the panel, ensuring that the electron beams land on the correct phosphor pixels. Accordingly, any deviation of the shadow mask from its original position acts to misdirect the electron beams to excite the unintended phosphor pixels.

The shadow mask can be repositioned in the CRT if it receives external shock or vibrations, or as a result of the impact from speakers mounted in the system to which the CRT is applied. That is, if the CRT receives a substantial degree of such forces, the shadow mask moves in the CRT such that electron beams passing therethrough land on the wrong phosphor pixel, thereby deteriorating color purity. This will be described in more detail hereinbelow.

FIG. 1 shows a partial sectional view of a conventional CRT used to describe the shifting of a shadow mask caused by an external shock. As shown in the drawing, the CRT includes a panel 1, a phosphor screen 2 formed on an inner surface of the panel 1, and a shadow mask 6 fixedly suspended a predetermined distance from the phosphor screen 2 and having a plurality of apertures (not shown) formed therein. The shadow mask 6 is mounted to a side wall of the panel 1. That is, a mask frame 5 joined to a periphery of the shadow mask 6 is coupled to a spring 4, and the spring 4 is connected to a stud pin 3 protruding from the side wall of the panel 1. An electron gun 11 is mounted in a funnel (not shown) of the CRT and emits electron beams 10 in a direction toward the shadow mask 6.

When the CRT receives a substantial external shock or vibrations, the shadow mask 6 is shaken and moves from its initial position to a deviated position 7. As a result, the electron beams 10 emitted from the electron gun 11 pass through an incorrect aperture of the shadow mask 6. That is, an electron beam that is intended to pass through a predetermined aperture 8 of the shadow mask 6, comes to pass through an incorrect aperture 9 as a result of the shadow mask 6 moving to the deviated position 7. Accordingly, a position P1 on the phosphor screen 2 on which the electron beam 10 lands is altered to deviated position P2, resulting in the excitation of the wrong phosphor pixel. This causes shaking of the displayed picture, a reduction in color purity and other picture quality problems.

Furthermore, in the case where the CRT receives an extreme shock, for example if the system in which the CRT is installed is dropped, it is possible for the shadow mask 6 to become deformed. An example of this is shown in FIG. 2 in which a deformed area 12 is illustrated. When electron beams 10 pass through the deformed area 12, the above problems of shaking of the displayed picture and a reduction in color purity occur, in addition to the generation of spurious colors.

To remedy the above described problems, Japanese Patent Laid-Open No. Sho 62-223950 discloses a technique for improving tensional strength of the shadow mask by forming a plating layer thereon. However, aperture size is decreased when using this technique.

Also, Japanese Laid-Open Nos. Sho 56-121257 and Hei 1-276542 each disclose a technique for improving tensional strength of the shadow mask by heat-treating the same in a gaseous atmosphere. However, in these conventional methods, the shadow mask is thermally deformed as a result of heat treating the same for long periods during the manufacturing process.

SUMMARY OF THE INVENTION

The present invention has been made in an effort to solve the above problems.

It is an object of the present invention to provide a shadow mask for a cathode ray tube (CRT) in which improvements in tensional strength and certain elongation properties of the shadow mask are realized such that deformation of the shadow mask caused by external shock is prevented.

It is another object of the present invention to provide a shadow mask for a cathode ray tube (CRT) in which an improvement in the modulus of elasticity for the shadow mask is attained so that the same is not negatively influenced by external vibrations and vibrations caused by the operation of speakers in a system to which the CRT is used.

It is still another object of the present invention to provide a method of manufacturing a shadow mask for a CRT in which no thermal deformation of the shadow mask occurs during its manufacture.

To achieve the above objects, the present invention provides a shadow mask for a CRT and a method for manufacturing the same, wherein a nitrogen compound is formed on a surface of or incorporated into the shadow mask. The method includes the steps of heat-treating a metallic plate having a plurality of apertures formed therein using a nitriding gas, and press-forming the metallic plate into a shadow mask shape.

According to a feature of the present invention, the nitriding gas is an ammonia gas.

According to another feature of the present invention, the amount of nitrogen compound contained in the shadow mask is 0.01 to 2.0 parts by weight based on the weight of the shadow mask.

According to yet another feature of the present invention, the shadow mask is made of a low thermal expansion material.

According to still yet another feature of the present invention, the shadow mask is made of AK steel or Invar. According to still yet another feature of the present invention, the temperature of the heat-treating step ranges from 400 to 700° C.

According to still yet another feature of the present invention, the heat-treating step is conducted for a period of 0.1 to 5 hours.

BRIEF DESCRIPTION OF THE DRAWINGS

The accompanying drawings, which are incorporated in and constitute a part of the specification together with the description, serve to explain the principles of the invention.

DETAILED DESCRIPTION OF THE INVENTION

A CRT shadow mask of the present invention is made of a low thermal expansion material, such as AK steel or Invar, including a nitrogen compound.

Figure 6:
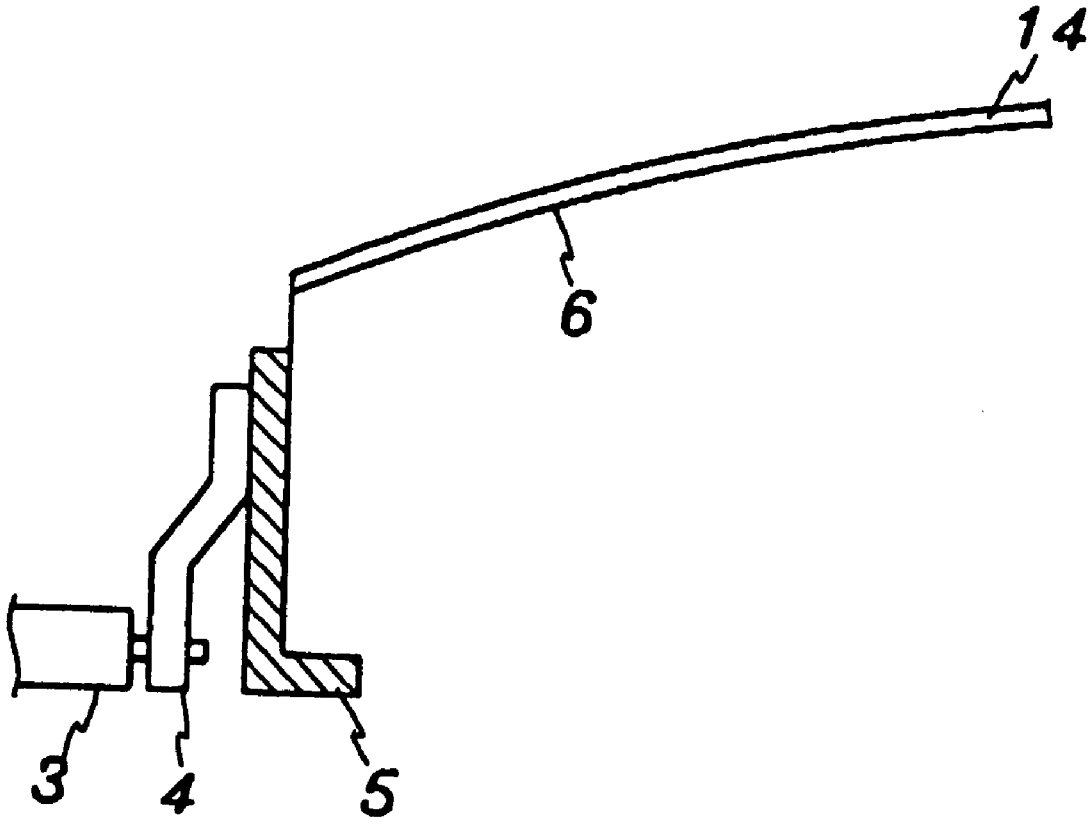
FIG. 6 depicts a shadow mask according to the invention.

An inventive method of manufacturing a shadow mask involves first stacking on a tray a predetermined number of metallic plates made of a low thermal expansion material, such as AK steel or Invar, and having a plurality of apertures formed in a predetermined area to form aperture portions. A pre-heating furnace is set to a temperature ranging from 300 to 500° C., and the tray having the stacked metallic plates thereon is placed in the pre-heating furnace. FIG. 6 depicts a shadow mask 6 having a nitrogen compound layer 14, in accordance with the invention.

Next, a reacting furnace is set to a temperature over 150° C. and a nitriding ammonia ($NH_3$) gas is fed into the reacting furnace. The nitriding gas is injected into the reacting furnace at a rate of 1 to 15 liters per minute. Subsequently, the temperature in the reacting furnace is increased to between 400 and 700° C., and the gaseous atmosphere therein is suitably maintained, after which the metallic plates in the pre-heating furnace are transferred to the reacting furnace.

If the temperature in the reacting furnace is maintained within the range described above, the ammonia gas decomposes into a source of free nitrogen atoms, which can effectively permeate the shadow mask. When the reacting furnace is set to less than 400° C., the temperature is inadequate to thermally decompose ammonia gas into a source of free nitrogen. However, it is unnecessary to surpass 700° C., because the ammonia gas fully decomposes into a source of free nitrogen atoms before reaching this temperature.

Although, it is possible to directly place the metallic plates in the reacting furnace without first heating them in the pre-heating furnace, there is a risk of exposing the reacting furnace to external atmospheric air, which may result in thermal shock. Placing the metallic plates first in the pre-heating furnace enables a more gradual increase in the temperature of the metallic plates, in addition to preventing an abrupt temperature decrease of the same after the heat-treating process.

The metallic plates are heat-treated in the nitriding gas inside the reacting furnace for between 0.1 and 10 hours. A heat-treatment period of between 0.1 to 2 hours results in nitrogen compound formation only on the surface of the shadow mask, while heat-treatment of the metallic plates for 2 to 10 hours results in the effective incorporation of the nitrogen compound into the shadow mask. Specifically, for a shadow mask having a thickness of 120 $\mu$m, heat-treatment for 0.1 to 2 hours results in a nitrogen compound layer of 5 to 20 $\mu$m formed on the surface of the shadow mask, in an amount of 0.01 to 2.0 parts by weight based on the weight of the shadow mask. Heat-treatment of the shadow mask of the same thickness for 2 to 10 hours incorporates the nitrogen compound into the whole shadow mask. Heat-treatment for less than 0.1 hours results in an insufficient reaction between the metallic plates and the gases. It is unnecessary to surpass 10 hours because the effects of heat-treating the metallic plates are fully realized before this time.

After the nitridation process is completed, the temperature in the reacting furnace is reduced to 150° C. while the atmosphere therein is maintained in the present state. When this temperature is reached, the injection of gas into the reacting furnace is discontinued. Next, the metallic plates are removed from the reacting furnace and then press formed into the desired shadow mask shape.

Figure 1:
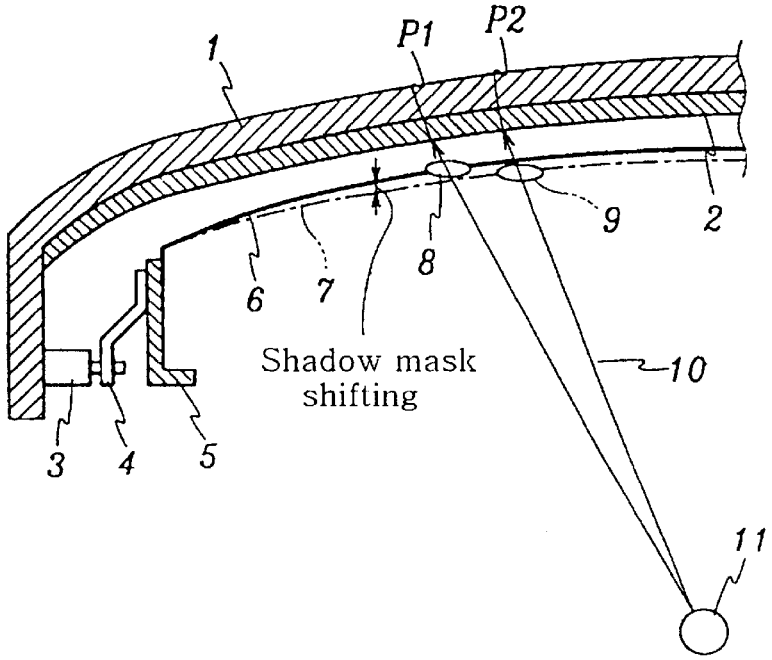
FIG. 1 is a partial sectional view of a conventional CRT used to describe shifting of a shadow mask caused by an external shock.
Figure 2:
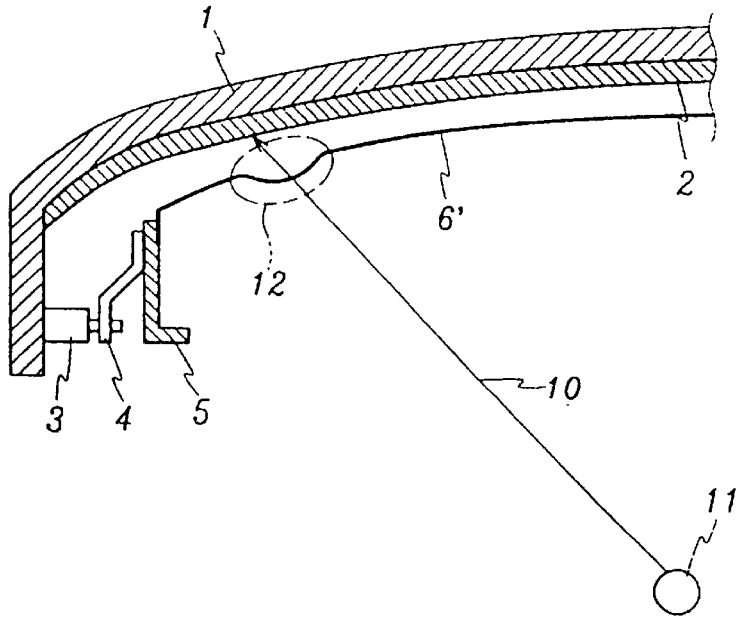
FIG. 2 is a partial sectional view of a conventional CRT used to describe damage to a shadow mask caused by an extreme external shock.
Figure 3:
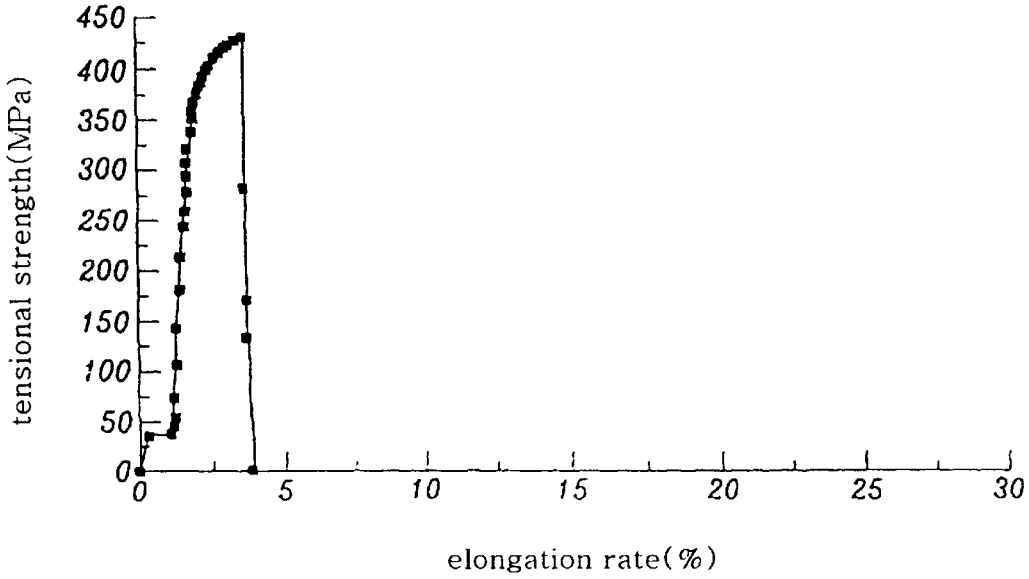
FIG. 3 is a graph illustrating the tensional strength and the elongation rate of a shadow mask manufactured without having undergone a conventional annealing process.
Figure 4:
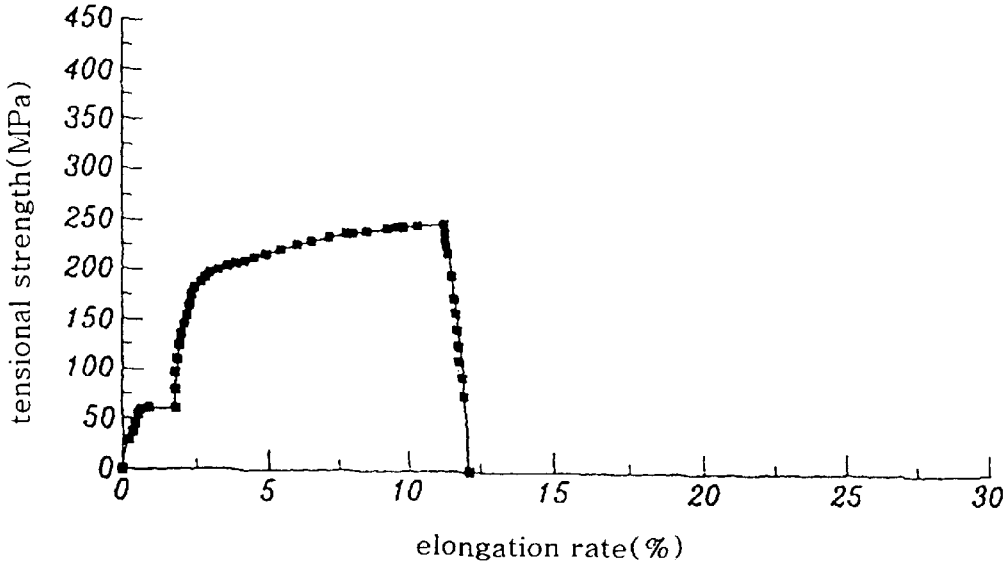
FIG. 4 is a graph illustrating the tensional strength and the elongation rate of a shadow mask manufactured after having undergone the conventional annealing process.

Because of the limited thickness of the metallic plates used to form the shadow masks, a rolling process must be undertaken a number of times during manufacture. Therefore, following the formation of the apertures in the metallic plates using an etching process, an annealing process is required before press-forming the metallic plates into the desired shape. As shown in FIG. 3, if the annealing process is not performed, although the tensional strength of the shadow mask is high, the elongation rate is low, thereby making it impossible to press-form the metallic plates into the shadow mask shape. Accordingly, it is necessary to conduct the annealing process. However, as shown in FIG. 4, annealing the metallic plates significantly lowers tensional strength while increasing the elongation rate.

Therefore, in the present invention, rather than utilizing the conventional annealing process, a nitridation is used, thereby increasing both the elongation rate and the tensional strength of the metallic plates used to manufacture the shadow masks. In nitridation, a source of free nitrogen is generated using ammonia gas in a reaction furnace maintained at a certain high temperature. The free nitrogen permeates or diffuses in the shadow masks such that a Fe—Ni—N compound or other nitrogen compound, such as $Fe_2N$, FeN, or $Fe_4N$, is formed as a result of the reaction between the free nitrogen and the shadow masks. As a result, the nitrogen compound is formed on the surface or incorporated throughout the whole shadow mask.

As can be seen in the graphs, the tensional strength of the shadow mask manufactured using the method of the present invention is significantly greater, by at least 100 Mpa, than the conventional annealed shadow mask. Further, the elongation rate of the inventive shadow mask is far greater than the non-annealed conventional shadow mask, and slightly improved over the annealed conventional shadow mask.

Accordingly, defects to the shadow mask occurring during the various manufacturing processes are minimized, and the shifting and deformation of the shadow mask caused by external shocks are reduced. Further, it is easier to roll-form the metallic plates used to manufacture the shadow mask after they have undergone the heat-treating process, and grains can be more evenly formed such that a sufficient elongation rate can be obtained. Additionally, since the modulus of elasticity of the inventive shadow mask is increased, movement caused by external vibrations and vibrations generated by speakers is reduced.

The present invention is explained in more detail with reference to the following example.

Example 1

A predetermined number of metallic plates, having a plurality of apertures formed over a predetermined area to form aperture portions, were stacked and loaded on a tray. Next, a pre-heating furnace was set and maintained at 400° C., after which the tray having the stacked metallic plates thereon was placed in the pre-heating furnace.

A reacting furnace was heated to a temperature of 550° C., and ammonia ($NH_3$) gas was injected into the reacting furnace at a rate of 5 liters per minute. Subsequently, the temperature in the reacting furnace was increased to 850° C., and the gaseous atmosphere therein was suitably maintained, after which the metallic plates in the pre-heating furnace were transferred to the reacting furnace.

The metallic plates were heat-treated in the nitriding gas atmosphere inside the reacting furnace for 1 hour, then the temperature in the reacting furnace was reduced to 150° C. while the atmosphere therein was maintained in its present gaseous atmosphere. After this temperature was reached, the injection of ammonia gas into the reacting furnace was discontinued. Next, the metallic plates were removed from the reacting furnace, then press-formed into the desired shadow mask shape.

The nitrogen compound contained in the shadow masks had a thickness of 10 $\mu$m and was present in an amount of 1 part by weight based on the weight of the shadow masks.

Figure 5:
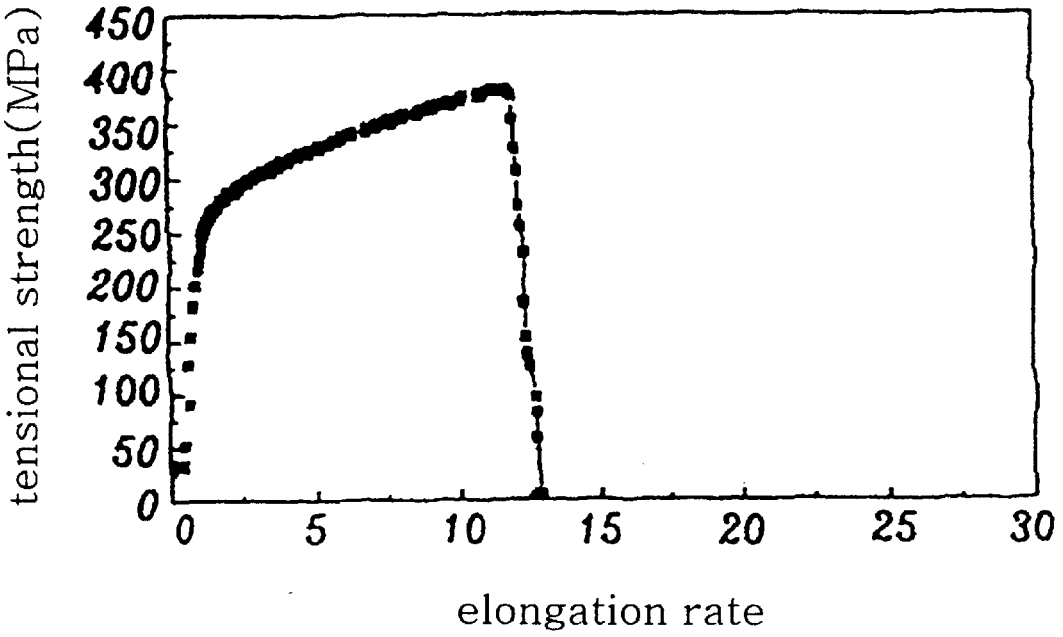
FIG. 5 is a graph illustrating the tensional strength and the elongation rate of a shadow mask manufactured using a nitridation according to a preferred embodiment of the present invention.

As shown in FIG. 5, the shadow masks obtained by the present invention utilizing the above nitriding process produced significantly improved properties of tensile strength and elongation.

FIGS. 3 and 4, respectively, show the tensile strength and elongation rate of non-annealed and annealed conventional shadow masks.

Example 2

A predetermined number of metallic plates, having a plurality of apertures formed over a predetermined area to form aperture portions, were stacked and loaded on a tray. Next, a pre-heating furnace was set and maintained at 400° C., after which the tray having the stacked metallic plates thereon was placed in the pre-heating furnace.

A reacting furnace was heated to a temperature of 550° C., and ammonia ($NH_3$) gas was injected into the reacting furnace at a rate of 5 liters per minute. Subsequently, the temperature in the reacting furnace was increased to 850° C., and the gaseous atmosphere therein was suitably maintained, after which the metallic plates in the pre-heating furnace were transferred to the reacting furnace.

The metallic plates were heat-treated in the nitriding gas atmosphere inside the reacting furnace for 5 hours, then the temperature in the reacting furnace was reduced to 150° C. while the atmosphere therein was maintained in its present gaseous atmosphere. After this temperature was reached, the injection of ammonia gas into the reacting furnace was discontinued. Next, the metallic plates were removed from the reacting furnace, then press-formed into the desired shadow mask shape.

A nitrogen compound present in an amount of 1.5 parts by weight based on the weight of the shadow mask was found to be incorporated throughout the shadow mask.

As described above, in the present invention, by subjecting a shadow mask, which has been etched and roll formed, to a nitridation process rather than an annealing process, a shadow mask having 50% increased tensile strength, as compared to an annealed shadow mask, is obtained.

Although the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method of manufacturing a shadow mask comprising the steps of:

heat-treating a metallic plate having a plurality of apertures formed therein in the presence of a nitridin gas; and thereafter press-forming the metallic plate into a shadow mask shape.

2. The method of claim 1 wherein, the shadow mask is made of a low thermal expansion material.

3. The method of claim 1 wherein, the shadow mask is made of aluminum-killed steel or Invar.

4.The method of claim 1 wherein, the nitriding gas comprises an ammonia gas.

5. The method of claim 1 wherein the heat-treating step is performed at a temperature ranging from 400 to 700° C.

6. The method of claim 1 wherein the heat-treating step is conducted for a period of 0.1 to 5 hours.

7. A method of manufacturing a shadow mask consisting essentially of the steps of:

heat-treating a metallic plate having a plurality of apertures formed therein in the presence of a nitriding gas; and thereafter press-forming the metallic plate into a shadow mask shape.

8. A method of manufacturing a shadow mask comprising the steps of:

heat-treating a metallic plate having a plurality of apertures formed therein in the presence of a nitriding gas; and thereafter, without annealing the metallic plate, press-forming the metallic plate into a shadow mask shape.

* * * * *